US009023212B2

(12) United States Patent
à Brassard

(10) Patent No.: US 9,023,212 B2
(45) Date of Patent: May 5, 2015

(54) DEVICE AND METHOD FOR SEPARATING MAGNETIC OR MAGNETIZABLE PARTICLES FROM A LIQUID

(75) Inventor: Lothar à Brassard, Heinsberg (DE)

(73) Assignee: chemagen Biopolymer-Technologie AG, Baesweiler (DE)

( * ) Notice: Subject to any disclaimer, the term of this patent is extended or adjusted under 35 U.S.C. 154(b) by 1848 days.

(21) Appl. No.: 11/815,316

(22) PCT Filed: Jan. 28, 2006

(86) PCT No.: PCT/EP2006/000747

§ 371 (c)(1),
(2), (4) Date: Aug. 2, 2007

(87) PCT Pub. No.: WO2006/081995

PCT Pub. Date: Aug. 10, 2006

(65) Prior Publication Data

US 2008/0308500 A1 Dec. 18, 2008

(30) Foreign Application Priority Data

Feb. 2, 2005 (DE) ..... 10 2005 004 664

(51) Int. Cl.
*B03C 1/30* (2006.01)
*B03C 1/06* (2006.01)
(Continued)

(52) U.S. Cl.
CPC ..... *B03C 1/286* (2013.01); *B03C 1/033* (2013.01); *B03C 1/30* (2013.01); *B03C 1/06* (2013.01); *B03C 2201/18* (2013.01); *B03C 2201/22* (2013.01); *B03C 2201/26* (2013.01)

(58) Field of Classification Search
CPC ..... B03C 1/002; B03C 1/02; B03C 1/031; B03C 1/023; B03C 1/025; B03C 1/033; B03C 1/029; B03C 1/03; B03C 1/0332; B03C 1/04; B03C 1/06; B03C 1/10; B03C 1/30; B03C 1/32; B03C 2201/28; B03C 2201/22; B03C 5/00; B03C 2201/18; B03C 2201/20; B03C 1/286; B03C 2201/26; B01D 35/06; B01D 2259/80; B01D 2259/814; C02F 1/48; C02F 1/481; C02F 1/484; C02F 1/488; C02F 2201/48
USPC ..... 422/100–101, 527; 210/222, 223, 695; 204/554, 557, 560; 209/217, 226, 215, 209/8, 214; 414/606; 446/135, 136, 133, 446/134; 335/283, 287, 298
See application file for complete search history.

(56) References Cited

U.S. PATENT DOCUMENTS 2,585,668 A * 2/1952 Meiklejohn ..... 209/3.1
5,567,326 A * 10/1996 Ekenberg et al. ..... 210/695
(Continued)

FOREIGN PATENT DOCUMENTS

CA 2 531 399 A1 1/2005
DE 195 28 029 A1 2/1997
(Continued)

*Primary Examiner* — David C Mellon
(74) *Attorney, Agent, or Firm* — Panitch Schwarze Belisario & Nadel LLP

(57) ABSTRACT

A device (10) is provided for separating magnetic or magnetizable particles from a liquid by using a magnetic field. The device includes a head piece (3) with one or more magnetizable bars (4) which is/are permanently or detachably connected with the head piece (3), as well as one or more permanent magnets (1) whose relative position with respect to the head piece can be changed by a predeterminable movement of the magnet(s) or/and by a predeterminable movement of the head piece.

29 Claims, 3 Drawing Sheets

(51) Int. Cl.
*B03C 1/033* (2006.01)
*B03C 1/28* (2006.01)

(56) References Cited

U.S. PATENT DOCUMENTS

| | | | | |
|---|---|---|---|---|
| 5,848,684 | A * | 12/1998 | Furlani et al. | 198/805 |
| 6,204,033 | B1 | 3/2001 | Muller-Schulte | |
| 6,409,925 | B1 | 6/2002 | Gombinsky et al. | |
| 6,942,806 | B2 | 9/2005 | Franzreb et al. | |
| 7,776,221 | B2 * | 8/2010 | Brassard | 210/695 |
| 2004/0029291 | A1 | 2/2004 | Franzreb et al. | |
| 2007/0175830 | A1 * | 8/2007 | Brassard | 210/695 |

FOREIGN PATENT DOCUMENTS

| | | | |
|---|---|---|---|
| DE | 296 14 623 | U1 | 2/1997 |
| DE | 100 57 396 | C1 | 4/2002 |
| DE | 100 63 984 | A1 | 6/2002 |
| WO | 2005/005049 | A1 | 1/2005 |

* cited by examiner

DEVICE AND METHOD FOR SEPARATING MAGNETIC OR MAGNETIZABLE PARTICLES FROM A LIQUID

CROSS-REFERENCE TO RELATED APPLICATIONS

This application is a Section 371 of International Application No. PCT/EP2006/000747, filed Jan. 28, 2006, which was published in the German language on Aug. 10, 2006, under International Publication No. WO 2006/081995 A1 and the disclosure of which is incorporated herein by reference.

BACKGROUND OF THE INVENTION

The invention relates to devices for separating and resuspending magnetic or magnetizable particles from liquids by means of a magnetic field produced by one or more permanent magnets.

The invention further relates to methods for separating magnetic or magnetizable particles from liquids and to the mixing and resuspending of magnetic or magnetizable particles in liquids by means of a magnetic field produced by one or more permanent magnets. The devices and methods can be used, for example, for applications in drug development, biochemistry, molecular genetics, microbiology, medical diagnostics and forensic medicine.

Methods that are based on magnetic separation using specifically binding, magnetically attractable particles or that enable the mixing of magnetic or magnetizable particles in solution are increasingly gaining in significance in the field of sample preparation for diagnostic or analytic examinations or in the field of performing diagnostic or analytic examinations. This is true, in particular, for automated processes since it is thereby possible to prepare or analyze a large number of samples within a short period of time and to dispense with labor-intensive centrifugation steps. This creates the conditions required for efficient, low-cost screening at a high sample throughput, which is extremely important for applications in molecular-genetic studies or in the field of medical diagnostics, for example, as it is practically impossible to manage or to pay for a purely manual handling of very large numbers of samples. Further important fields of application relate to pharmaceutical screening methods for identification of potential pharmaceutical active agents.

The basic principle of magnetic separation of substances from complex mixtures is based on the process of functionalizing magnetic particles (magnetizable or magnetically attractable particles) in a specific manner for the intended separation process, that is, they are provided, by chemical treatment, with specific binding properties for the target substances to be separated. The size of these magnetic particles is typically in the range of approx. 0.05 to 500 μm.

Magnetic particles that have specific binding properties for certain substances and can be used to remove these substances from complex mixtures are described, for example, in German published patent application DE 195 28 029 A1 and are commercially available (e.g. from chemagen Biopolymer-Technologie AG, DE-52499 Baesweiler, Germany).

In known separating methods the functionalized magnetic particles are added in a first step ("binding step") to a mixture to be purified which contains the target substance(s) in a liquid promoting the binding of the target substance molecules to the magnetic particles (binding buffer). This causes a selective binding of the target substance(s) present in the mixture to the magnetic particles. Subsequently, these magnetic particles are immobilized (as a "pellet") on a site of the interior wall of the reaction vessel by employing magnetic forces, that is, a magnetic field, for instance by means of a permanent magnet. Thereafter, the liquid supernatant is separated and discarded, for example by suction or decanting. Since the magnetic particles are immobilized in the manner described, it is largely prevented that these particles are removed along with the supernatant.

Subsequently, the immobilized magnetic particles are again resuspended. For this purpose an eluting liquid or eluting buffer is used that is suitable for breaking the bond between the target substance(s) and the magnetic particles, so that the target substance molecules can be released from the magnetic particles and removed along with the elution liquid while the magnetic particles are immobilized by the action of the magnetic field. One or more washing steps may be carried out prior to the elution step.

If appropriately functionalized, the magnetic particles can also be utilized directly for diagnostic or analytical examinations. In this case, functionalization enables the specific binding, for example, of pathogenic substances. However, in order to be able to make a statement that is as definite as possible, e.g. with regard to a pathogenic substance, suitable solutions must be freed from all impurities. To this end, the particles, to which the analytes adhere, must be mixed (washed) as efficiently as possible. The present invention facilitates such a process, particularly if there are large numbers of samples to be treated simultaneously or if one has to work with small volumes (384 or 1536 formats).

Devices of various types have been described for carrying out separation processes by means of magnetic particles. German utility model DE 296 14 623 U1 discloses a magnetic separator provided with movable permanent magnets. As an alternative it is proposed to move the reaction vessel containing the magnetic particles, by mechanical drive means, relative to a fixedly mounted permanent magnet. The device described in DE 296 14 623 U1 does not have magnetizable bars that are immersed in the sample liquid; rather, the permanent magnets are positioned next to the individual reaction vessels.

The device described in German published patent application DE 100 63 984 A1, which is provided with a magnet holder and a movable reaction vessel holder, also works according to a similar principle, it being possible to position the magnets laterally at the reaction vessels.

By using the above-mentioned devices it is possible to immobilize or accumulate the magnetic particles on the interior wall or on the bottom of a reaction vessel as a "pellet". These devices are, however, not suitable for removing the magnetic particles from a reaction vessel. As a consequence it is necessary to exhaust the liquid from each individual reaction vessel by suction in order to separate the liquid from the magnetic particles. This is a disadvantage as it entails high material consumption (disposable pipette tips). Furthermore, it is unavoidable that individual magnetic particles are also sucked off, thus leading to a high error rate. Other errors can be caused by liquids dripping down, leading to cross-contamination.

German Patent DE 100 57 396 C1 proposes a magnetic separator provided with a plurality of rotatable bars that can be magnetized by an electromagnetic excitation coil. By immersing the bar in the liquid containing magnetic particles and withdrawing the bar in the magnetized state, the magnetic particles can be removed from the liquid and, if required, transferred to another reaction vessel where they can be re-released into a liquid, e.g. a wash or elution liquid, by deactivating the excitation coil.

A disadvantage of this device is that the excitation coil requires a relatively large space, which results in limitations of design and construction.

In addition, the positioning as well as the number of the bars is dependent on the geometry of the electromagnet, which may lead to limitations in the processing of samples. However, the geometry of the electromagnet cannot be altered arbitrarily as this would mean that inhomogeneity of the magnetic field would have to be accepted.

The known devices are, above all, not suitable for treating larger numbers of samples, as is required for high-throughput applications (e.g. microtiter plates with 364 or 1536 wells). The effort and expenditure in terms of construction would be immense, and, in addition, one would have to accept a significantly higher susceptibility to malfunction of the mechanical equipment employed.

Furthermore, the known devices are disadvantageous since they are suitable only for individual sample vessels or only for a certain, unalterable, pre-determined arrangement of sample vessels, e.g. in the form of a 96-well microtiter plate. However, for practical purposes it is desirable that such a magnetic separator device be suitable for, or can be converted for different types of sample vessels or for different arrangements of sample vessels (e.g. microtiter plates with 96, 364 or 1536 wells).

BRIEF SUMMARY OF THE INVENTION

An object of the invention was therefore to provide devices and methods enabling the separation of magnetic particles from liquids and the transfer of magnetic particles from one liquid into another liquid while avoiding the above-mentioned disadvantages. More particularly, the devices and methods are to be suitable for use in high-throughput processes. The devices should be suitable for versatile applications and, in particular, for different types of reaction vessels.

These and other objects are, surprisingly, achieved by the devices and methods as described and claimed below.

Thus, the devices of the invention for separating magnetic or magnetizable particles from a liquid are characterized by the following features:

a head piece with one or more magnetizable bars, which bar(s) is/are connected in a fixed or detachable manner with the head piece;

one or more permanent magnets whose relative position with respect to the head piece can be changed by a predeterminable movement of the magnet(s) or/and by a predeterminable movement of the head piece.

The mode of operation of the device is based on the possibility of positioning the permanent magnet(s) above the head piece (together with the bars attached thereto). The bar or bars is/are thereby magnetized. This state of the device is designated as "activated". When the magnetizable bars are immersed with their lower end or section in, for example, a sample liquid containing magnetic particles, the magnetic particles will adhere to the lower end of the bars due to the magnetic forces. These bars, along with the magnetic particles adhering thereto, can then be immersed in another liquid (e.g. a reagent or wash solution).

When the permanent magnet(s) is/are removed from the position located above the head piece, the magnetization of the bars can thereby be eliminated so that the magnetic particles drop off from the bars or can be detached by a shaking motion. This state of the device is designated as "deactivated". The movement of the magnet(s) enables a rapid alternation between the activated state and the inactivated state of the magnetic separator.

In accordance with the invention, the permanent magnets are arranged so as to be movable relative to the head piece, so that the magnetization of the magnetizable bars attached to the head piece can be alternately activated and deactivated by moving the magnet(s). To this end, the magnet(s) is/are moved above the head piece and away from the head piece, respectively.

As an alternative, magnetization and demagnetization can also be achieved by moving the head piece below the magnet(s) and away from the magnet, respectively; in this case the magnet(s) are preferably arranged so as to be stationary.

By moving the head piece (along with the magnetizable bars attached thereto) the head piece can be brought into a first position in which it is underneath the region of the permanent magnet(s) (activated state), or into a second position in which it is outside the region (inactivated state).

Because it is possible to magnetize the bars temporarily, the device can be employed for removing magnetic particles from a first liquid by means of the magnetizable bars and transferring them into a second liquid or further liquids in order to release the particles therein.

By positioning a permanent magnet, which may also be composed of a plurality of individual magnets, a substantially homogeneous magnetic field is produced. In this way it is possible to dispose a larger number of bars, for instance in several rows, with the magnetic field being approximately of the same size at each of the bars; this is of particular advantage with a view to the reproducibility of high-throughput processes. A further advantage of the devices according to the invention is that the magnetic particles—in the magnetized state—accumulate substantially at the tips of the bars and that it is thereby possible to receive the substances to be separated, which adhere thereto, in comparatively small elution volumes. This guarantees high concentrations of the substances to be separated, which is of essential importance in diagnostic or analytical examinations.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
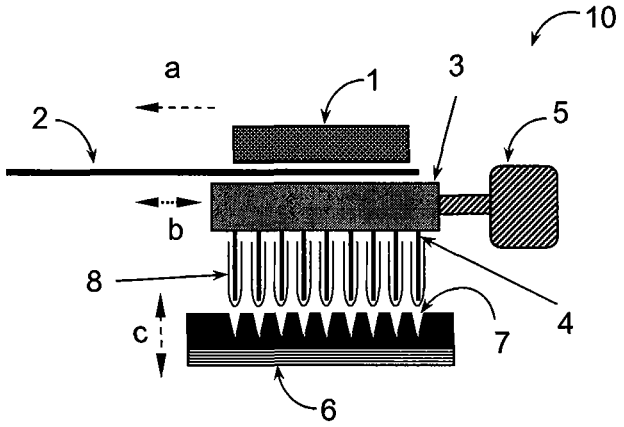
FIGS. 1A and 1B are side schematic views of one embodiment of a device according to the present invention, FIG. 1A illustrating the activated state, and FIG. 1B illustrating the deactivated state.

Basically, any hard-magnetic materials known to the person skilled in the art may be used to produce the permanent magnets, particularly ferrite, Al—Ni—Co alloys and rare earth magnets (preferably NdFeB); such magnetic materials and magnets are commercially available from various manufacturers.

The number of magnetizable bars attached to the head piece depends on the maximum number of samples, that is, on the maximum number of recesses ("wells") in the liquid containers, which are to be treated simultaneously. As containers, microtiter plates are used with preference, especially those with 96, 384 or 1536 wells, so that corresponding numbers of magnetizable bars are provided for those cases. Furthermore, also suitable as containers are sample tubes or reaction vessels of a volume of, for example, 0.015 to 100 ml; these can be treated individually or in groups, in each case in combination with magnetizable bars adapted thereto.

The magnetizable bars, optionally the head piece as well, are preferably made of a soft-magnetic material, for example of soft iron (especially Fe—Ni alloys) or magnetizable steel. The length and cross-section thereof are dependent on the intended application purpose, especially on the dimensions of the containers and on the volumes of liquid, and can be varied accordingly. If a group of a plurality of bars (e.g. 96, 384 or 1536) is used, these bars are each of the same length, thickness and material characteristics. The bars may optionally be hollow inside, i.e. formed as tubes, with the lower end preferably being closed. More particularly, the bars may be formed as shells, as described further below.

Generally, the magnet bars are oriented so as to be substantially vertical and parallel to one another, and the individual bars of a group or arrangement are preferably located at the same distances to the respective neighboring bars. A grid-like arrangement of the bars that corresponds to the arrangement of the wells of conventional microtiter plates is especially preferred.

Hence, the invention also encompasses arrangements of magnetizable bars wherein a plurality of magnetizable bars (4) is attached to a base plate (9), the bars being oriented substantially parallel to one another and preferably in one, two or more rows, each row comprising two or more bars.

The magnetizable bars, whether permanently or detachably connected with the head piece, are preferably of a thickness of 0.5 mm to 10 mm, especially 1 to 5 mm. The length of the bars is preferably 1 to 20 cm, especially 5 to 10 cm. To permanently connect the bars with the head piece (as mentioned), means that are conventionally used in the art may be employed (e.g. adhesive bonding, screwed connections, welding).

According to another embodiment, the head piece (without the bars) may also be made entirely or partially from a non-magnetic or non-magnetizable material.

To detachably attach the magnetizable bars, the bars are preferably connected with the head plate by clamp connection. For example, the head piece may be provided with corresponding recesses or holes at its bottom side, into which the bars can be inserted. Alternatively, bars may be used which are tube-like or which have a recess at least at their upper end and which can be slipped onto corresponding pins or protrusions provided at the bottom side of the head piece.

Preferably, the head piece is provided with a mechanism which releases the clamp connection between the bars and the head piece and thus causes the bars to be pushed off or discarded when the bars are to be replaced, after use, by unused bars. This may preferably be accomplished by an electromotive drive or by pneumatic, electromagnetic or hydraulic means, or by a combination thereof.

According to a preferred embodiment, the magnetizable bars are arranged on a base plate and form a unit therewith. In this case, it is preferred that the base plate can be detachably connected with the head piece. Optionally, the base plate and the bars located thereon may be made in one piece.

Base plates with bars attached thereto may be produced by means of known materials and methods for the production of molded articles, for example by deep-drawing methods, extrusion methods, welding, adhesive bonding, etc. Preferably, the units, consisting of base plate and bars connected therewith, are produced and employed as disposables.

In accordance with another preferred embodiment, the base plate is provided with a plurality of magnetizable bars which are arranged in one or more rows, each row comprising a plurality of rows. The bars are preferably arranged in a regular matrix, for example coinciding with the arrangement of the recesses of a microtiter plate (especially a microtiter plate with 96, 384 or 1536 wells). The base plate generally has a rectangular or square horizontal projection.

By using a detachably attached base plate (with bars arranged thereon) it is made possible to convert the device in a simple manner so that it is suitable, for example, for different types of microtiter plates.

The detachable connection between the base plate and the head piece can be accomplished in a manner known to those skilled in the art, e.g. by gripping, chucking or clamping devices, levers, springs, etc.

According to a particularly advantageous embodiment, the device is provided with means by which the bars, or the base plate together with the bars attached thereto, can be detachably connected with the head piece and/or removed from the head piece. The means are preferably actuated by an electromotive drive or by pneumatic, electromagnetic or hydraulic means, or by a combination thereof. In this way, receiving, attaching and discarding the base plate can take place in a self-actuated or automatic manner, and these operations can be controlled, for example, by a program.

In another, particularly preferred embodiment of the invention the bar(s)—irrespective of whether these are permanently or detachably, or with or without a base plate, connected with the head piece—are each provided with a strippable, replaceable shell. The advantage thereof is that the shell can be replaced and renewed between the individual operating cycles so that cross-contamination between different samples and carry-over of sample material can be prevented.

Preferably, the shells are dimensioned—depending on the dimensions of the bars—such that they can be attached to the bars by clamp connection. To facilitate slipping the shells on the bars, it is preferable that the group of shells be provided on a dispensing device, the arrangement of the shells on the dispensing device corresponding to the respective arrangement of magnetizable bars (e.g. arrangement corresponding to the distances between the individual recesses of a microtiter plate).

It is particularly advantageous if a plurality of shells is connected with one another and forms a common unit. In this way, replacing the shells is considerably facilitated. Preferably, the number and arrangement of shells on such a unit corresponds to the respective number and arrangement of the magnetizable bars.

The invention also encompasses arrangements of shells that are suitable for use with any one of the devices according to the invention; especially arrangements having a plurality of shells (8) which can be slipped onto the magnetizable bars of the device and which are arranged substantially parallel to one another. Preferably, the shells are arranged in one, two or more rows, each row comprising two or more bars.

The above-mentioned shells may be made of known materials, e.g. plastics such as polyethylene, polypropylene, Teflon, polyethylene terephthalate, nylon, polyvinyl chloride, etc., or of metallic materials such as stainless steel, tinplate, aluminum foils, etc., or of combinations of such materials, in a manner known to the skilled artisan (more particularly by injection molding or deep drawing).

It is furthermore possible to produce the shells, or the shells connected so as to form a common unit, from a magnetizable material (as mentioned above). In this case, the magnetizable shells or the magnetizable shells connected to form a unit take the function of the above-described magnetizable bars or of the magnetizable bars connected with a base plate.

Preferably, the units made from groups of shells are produced and used as disposables to exclude contamination.

According to another preferred embodiment, the device according to the invention is provided with means by which the replaceable shells, or the shells forming a common unit, can be received and retained at the bars—or at the head piece of the device—and/or removed or discarded from the bars (respectively from the head piece). The means are preferably operated by an electromotive drive or by pneumatic, electromagnetic or hydraulic means, or by a combination thereof. In this way, receiving, attaching and discarding of the shells can take place mechanically or automatically, in particular in a program-controlled manner.

The device may furthermore be provided with devices by which individual shells, arrangements of shells or shells connected with one another can be provided automatically or in a program-controlled manner (e.g. in a rack or dispenser) so that they can be received by the bars or the head piece.

To enable the replacement of the shells, or of the shells forming a common unit, the shells may be attached to the bars by clamping (as mentioned); as an alternative or in addition thereto, the shells may be attached to the bars or/and to the head plate or other parts of the device in a manner known to the skilled artisan, e.g. by gripping, chucking or clamping devices, levers, springs, etc.

In accordance with a further preferred embodiment it is provided that the head piece of the device be arranged so as to be moveable and that it can be set into motion by a drive device. Suitable as a drive device are, in particular, electromotive, pneumatic, electromagnetic or hydraulic drive means or a combination thereof.

Preferably, the head piece is moveably arranged such that it is able to perform one or more of the types of motion indicated below:

translatory movements in a horizontal plane;

movements along a circular path, an elliptic path or an irregular path, in each case within a horizontal plane;

movements in a vertical direction.

The vertical direction corresponds substantially to the longitudinal direction of the, substantially vertically oriented, magnetizable bars.

The vertical movements serve, in particular, to immerse the bars into the sample liquid and to withdraw the bars from the liquid. The horizontal movements can be employed, in particular, to perform shaking and vibrating movements (e.g. circular movements or movements of the kind performed by an orbital shaker). Suitable mechanisms for accomplishing the above-mentioned types of motion are known to those skilled in the art.

To separate magnetic particles, liquids containing such particles are introduced below the magnetizable bars; for this purpose, containers of the type mentioned at the outset can be used. Preferably, at least one holder is provided for this purpose which can be positioned below the bars, so that the bars are oriented towards the openings of the containers. This holder may be configured, for example, in the form of a holder plate.

The holder is preferably arranged so as to be moveable, and it can be set into motion by a drive device, so that it is possible to position the sample vessels alternately in a region located underneath the bars and in a position outside the region.

The present invention, in particular, comprises embodiments wherein the holder is movable in an essentially horizontal plane in one or more directions; alternatively or in addition thereto, the holder may be movable in the vertical direction.

Preferably, the holder is moveably arranged such that it is able to perform one or more of the types of motion indicated below:

translatory movements in a horizontal plane;

movements along a circular path, an elliptic path or an irregular closed path, in each case within a horizontal plane;

movements in a vertical direction;

the vertical direction corresponding substantially to the longitudinal direction of the magnetizable bars (4).

As drive device for the holder, electromotive, pneumatic, electromagnetic or hydraulic drive means, or combinations thereof, are used with preference.

In particular, the holders and their drive devices may also be configured such that they can be used for carrying out shaking or vibrating movements. The constructional measures required therefor are in principle known to the person skilled in the art.

It is furthermore provided in accordance with a further embodiment that both the head piece and the holder be movable and, in particular, able to carry out shaking movements. It is thereby possible to achieve an especially effective intermixing of the sample liquid when the bars are immersed therein.

According to another embodiment of the invention, the device is equipped with a movable holder, whereas the head piece is arranged so as to be immobile.

According to a further, particularly advantageous embodiment of the invention, the holder is a component of a program-controlled laboratory robot system. Preferably, it is adapted such that a plurality of individual ones of the containers or of groups of such containers, particularly microtiter plates, is alternately moved into a position below the bars and subsequently, after a predeterminable time interval, again into a position which is outside the region located below the bars. It is thereby possible to achieve a high sample through-put.

In connection with the afore-described embodiment, it is furthermore preferred that a device for open-loop control or closed-loop control be provided, by means of which the vertical movement of the holder(s) can be adjusted or controlled such that an upward movement of the holder causes the bars to be immersed in the containers, which are filled with liquid.

As mentioned at the outset, the mode of operation of the device according to a preferred embodiment is based on the possibility of positioning the permanent magnet(s) above the head piece and of subsequently withdrawing them from that position.

To allow movement of the permanent magnet(s) in order to activate and deactivate the magnetic field, the magnet or a group of several magnets may be arranged in a displaceable, rotatable or tiltable manner in a device provided for this purpose. By displacing, rotating or tilting, the magnet can moved into a position in which its poles, and thereby its magnetic field, point in the direction of the magnetic circuit (activated state, maximal field strength at the bars), or it can be moved into another position in which the magnetic field emanating therefrom does not magnetize the bars of the head piece (deactivated state). The magnet(s) may also be displaced, rotated or tilted into intermediate positions to achieve a field strength at the magnetizable bars that is below the maximum value.

According to a preferred embodiment, the movement of the permanent magnet(s) is made possible by arranging the permanent magnet(s) displaceably such that it/they can be moved by displacement (or tensile forces) from outside into the region located above the head piece, and then again out of the region. To enable displacement, the permanent magnet may be supported on rails, rollers or gear racks, for example.

According to a further preferred embodiment, the movement of the permanent magnet(s) is made possible by arranging the permanent magnet(s) (1) on a rotatable or tiltable device by means of which the permanent magnet(s) can be moved above the head piece and then away therefrom.

The movement (e.g. tilting, rotating, displacing) of the permanent magnets may be accomplished either in a direct or indirect manner, manually or by means of a drive device which preferably comprises electromotive, pneumatic, electromagnetic or hydraulic drive means, or a combination thereof. These drive means are generally known to those skilled in the art, likewise are further components (e.g. gear unit, linkage) that may also be required for the drive device.

In addition, one preferred embodiment is preferably equipped such that the extent of the movement of the permanent magnet(s) is predeterminable (e.g. rotation or tilting angle, displacement distance).

According to another preferred embodiment of the invention, it is provided that a program-controlled processor be associated to the device and connected therewith. The program-controlled processor enables open-loop control or closed-loop control of at least one of the following functions of the device, or the coordination or synchronization of at least two of the functions mentioned below:

movement of the permanent magnet(s), particularly the time intervals within which the magnet(s) are positioned above the magnetizable bars;

movement of the head piece in horizontal or/and vertical direction, particularly duration, frequency and amplitude of a shaking or vibrating motion;

actuating the means for detachable attachment of the base plate to the head piece and for removal of the base plate from the head piece;

actuating the means for retaining the shells at the bars and for removing the shells from the bars;

movement of the holder in order to position containers or groups of containers alternately below the bars and subsequently to remove them from that position, particularly velocity and frequency of the movements, as well as the dwell time of the holder below the bars;

vertical movement of the holder in order to immerse the bar/the bars into the liquid of the container(s) and remove the same therefrom; particularly immersion depth, duration and frequency;

if provided, rotation, shaking or vibrating motion of the holder, particularly rotation speed, rotation amplitude and intervals between the individual operation phases.

The devices according to the invention may advantageously be combined with other devices for automatic treatment of sample material. Furthermore, two or more of the devices according to the invention may be arranged side by side and combined with one another.

The invention therefore also encompasses devices of the type described above to which one or more of the following means are associated, the functions of the means preferably being coordinated with the functions of the device by means of a common control:

one or more thermostatable heating or cooling means;

one or more pipetting stations for metered addition of liquids, especially reagents;

one or more suction means for exhausting liquid from the containers;

one or more means for shaking or intermixing the liquids contained in the containers;

analytic apparatuses, particularly for photometric measuring or luminescence detection.

The invention further comprises methods for separating magnetic or magnetizable particles from a liquid by using a magnetic field; these methods can be performed using one of the above-described devices. These inventive methods, in accordance with a preferred embodiment comprise the following steps:

a) immersing at least one magnetizable bar of the device into the liquid containing the particles;

b) activating a magnetic field by changing the position of a permanent magnet relative to the magnetizable bar, whereby the bar is magnetized and the particles accumulate substantially at the lower end of the bar;

c) removing the bar, along with the adhering particles, from the liquid.

The devices and methods according to the invention can advantageously be used for separating and/or mixing a target substance from/into a liquid mixture of substances or a solution. To this end, the magnetizable bars are immersed in a liquid containing a target substance which is bound specifically, but reversibly, to the particles. The target substances may be antibodies, enzymes, receptors, ligands, pharmaceutical active substances and nucleic acids, for example. These may also be present in the form of complex mixtures with other substances, in which case the target substances are bound specifically to the magnetizable particles, depending on the binding properties of the latter.

In further operation steps it may be expedient to wash the magnet particles together with the adhering target substances in suitable wash solutions. For example, such a washing procedure may take place as follows:

d) immersing the bar, along with the particles adhering thereto, in a predetermined volume of a wash liquid;

e) deactivating the magnetic field by an opposite change of the position of the permanent magnet, whereby the particles are released into the liquid;

f) mixing;

g) magnetizing the bars by changing the position of the permanent magnet(s), whereby the particles accumulate substantially at the lower end of the bar;

h) lifting the bar out of the wash liquid.

In many cases it is desirable to elute the target substances from the magnet particles, after binding to the magnet particles and after the separation of the latter. According to a further embodiment of the invention it is therefore provided that the method comprises the following additional steps:

i) immersing the bar, along with the particles adhering thereto, into a predetermined volume of an elution liquid that causes the elution of the target substance from the particles;

k) lifting the bar out of the elution liquid, during which process the particles remain adhering to the bar and are thereby separated from the liquid.

To improve purity and yield, it may be advantageous to release the particles into the liquid, subsequent to step b) or d), by deactivating the magnetic field, to mix the liquid and subsequently to re-accumulate the particles on the bars by activating the magnetic field. Intermixing can be accomplished, for example, by shaking the holder or/and the head piece.

By using one of the above-described devices according to the invention it is possible to carry out the above-mentioned methods in a particularly simple and rapid manner. The devices and methods according to the invention can be used to particular advantage for the application fields mentioned at the outset, especially for high-throughput methods.

According to a further preferred embodiment, it is provided that in the method according to the invention the magnetizable bars be replaced and renewed between two work cycles or between two process steps, for example to avoid cross-contamination. Therefore, such a method additionally comprises at least one of the below-mentioned steps:

l) a first group of magnetizable bars, or a plurality of bars connected to form a common unit, is detachably attached to a device comprising one or more arranged permanent magnets whose relative position with respect to the magnetizable bars can be changed;

m) the first group of magnetizable bars is separated from the device or discarded therefrom, and replaced by a second group of magnetizable bars which is detachably attached to the device.

As an alternative to this measure, or in addition thereto, it is provided, in accordance with a further embodiment of the method of the invention, that the magnetizable bars be equipped with shells which are replaced and renewed between two work cycles or between two process steps in order to avoid carry-over of reagents or cross-contamination.

Therefore, such a method additionally comprises at least one of the below-mentioned steps:

n) a first group of shells, or shells connected to form a common unit, is/are slipped on the magnetizable bars of a device according to claim 1;

o) the first group of shells is stripped off or discarded from the magnetizable bars of the device and replaced by a second group of shells which are slipped onto the bars.

The invention will now be explained by way of example with reference to the appended schematic drawings. Unless otherwise indicated, the reference numbers have the same meaning in all the drawings. Since the drawings are merely schematic representations, the actual size ratios may vary therefrom.

Figure 1B:
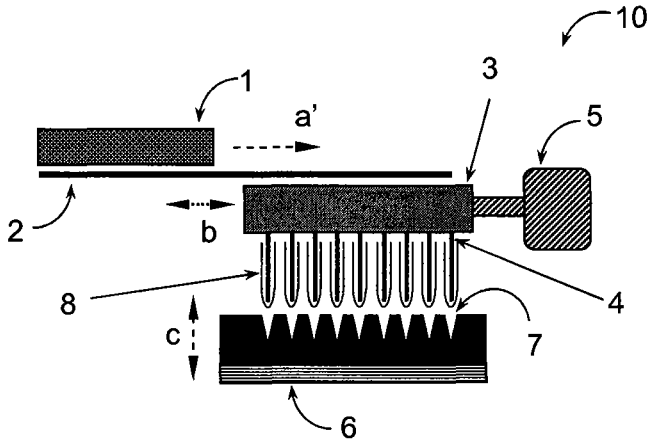

FIGS. 1A and 1B depict, in side view, an embodiment of a device (10) according to the present invention, with FIG. 1A illustrating the activated state and FIG. 1B illustrating the deactivated state. The device (10) has a permanent magnet (1) that is displaceably arranged on rails (2) and can be moved in a horizontal plane in the direction of the arrow (a). A stationary frame of the device (not shown) carries a head piece (3) with magnetizable rods or bars (4) attached thereto. Underneath the rods there is a vertically displaceable holder (6). On the holder there is disposed a sample container (7) having a plurality of recesses for receiving the samples of liquid, the container may, for example, be fixed to the holder (6) in a detachable manner.

The head piece (3) is connected with a drive unit (5) by which it is possible to set the head piece, together with the rods attached thereto, in motion, preferably a shaking motion in a horizontal plane, as indicated by arrow (b). The holder (6) is equipped with a drive unit (not shown) enabling an upward and downward movement of the holder (arrow c). Shells (8) are slipped or clamped onto the bars (4).

The bars are permanently connected with the head piece; alternatively they may be connected with the head piece in a detachable manner.

As can be seen, the magnet (1) in FIG. 1A is in a position essentially above the head piece and the magnetizable bars, so that the bars can be magnetized by the magnet. Thereby, a magnetic field is generated at the ends of the bars (7) that can be employed for attracting magnetic particles. In FIG. 1B (deactivated state) the magnet has been moved out of this position and is no longer located above the bars (4).

Figure 1C:
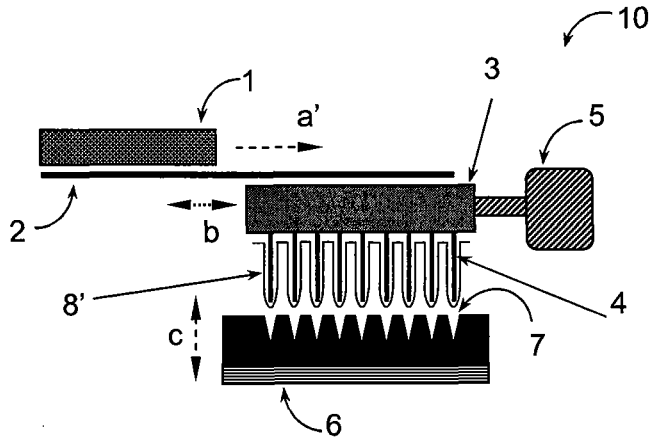
FIG. 1C is a side schematic view of a modified embodiment of the device of FIGS. 1A and 1B.

FIG. 1C shows a modification of the device depicted in FIGS. 1A and 1B, wherein the shells (8') are connected with each other at their upper ends, jointly forming a unit.

Figure 2A:
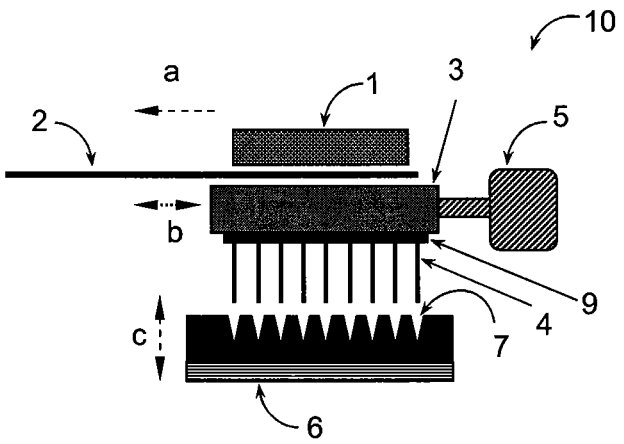
FIGS. 2A and 2B are side schematic views of another embodiment of a device according to the present invention, FIG. 2A illustrating the activated state, and FIG. 2B illustrating the deactivated state.
Figure 2B:
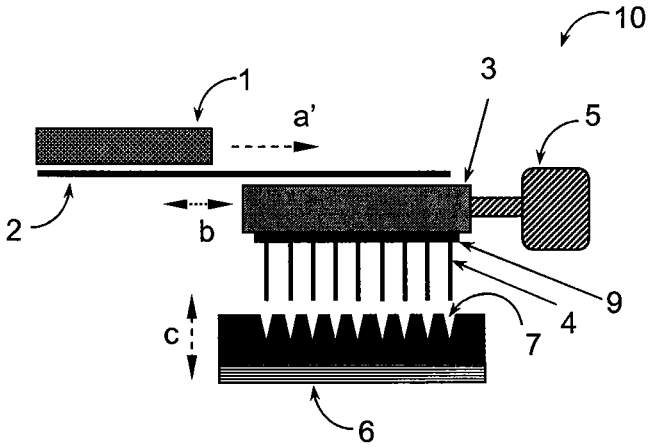
Figure 2C:
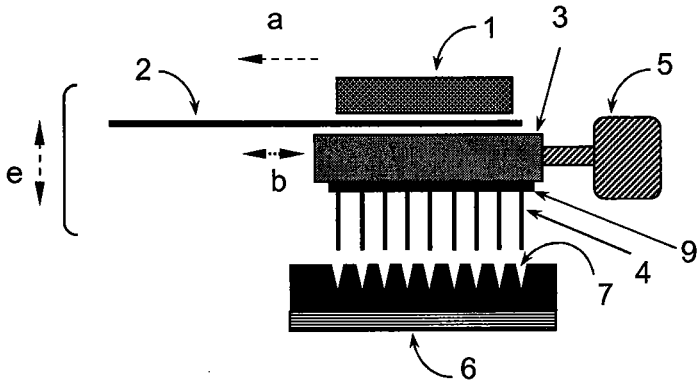
FIG. 2C is a side schematic view of another embodiment similar to that of FIG. 2A, but with vertical movability of the head piece and magnet.

FIGS. 2A to 2C depict another embodiment of the device (10), wherein a plurality of bars (4) is connected, in a regular arrangement, with a base plate (9) and forms a unit therewith. Preferably, the plate (9) is detachably attached to the head piece (3), in which case the head piece is preferably equipped with a holding and discarding device (not shown) enabling automatic holding and discarding of the plate by the head piece. FIG. 2A shows the activated, FIG. 2B the deactivated state.

FIG. 2C shows a further advantageous embodiment of the invention (in the activated state) wherein the entire unit which comprises the head piece and the magnet can be moved downwards and upwards, preferably by means of drive means of the above-mentioned type. In this case, the vertical movability of the holder (6) can be dispensed with.

Figure 2D:
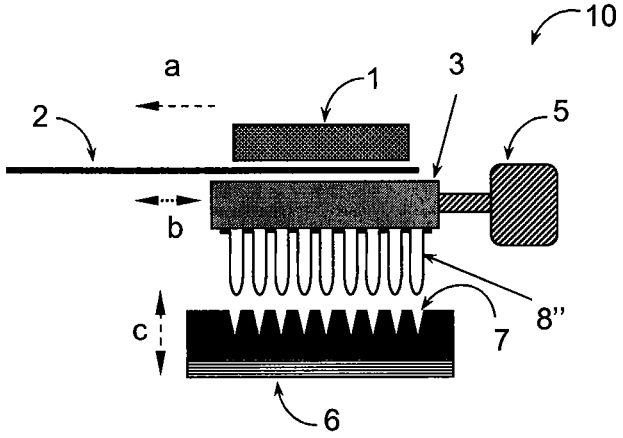
FIG. 2D is a side schematic view of a further embodiment of a device according to the present invention.

FIG. 2D shows a further, advantageous embodiment of the invention wherein instead of a base plate (9), with bars (4) attached thereto, there is employed a group of shells or hollow bars (8") that are interconnected to form a unit; in this case, the shells are made of a magnetizable material.

Figure 3:
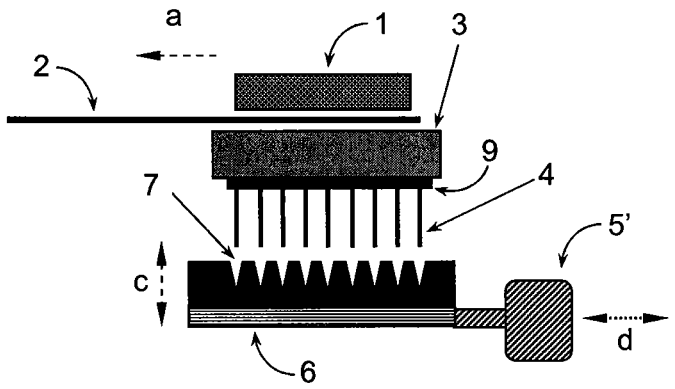
FIG. 3 is a side schematic view of still further embodiment of a device according to the present invention, providing horizontal movability of the holder.

FIG. 3 shows another embodiment of the inventive device, wherein the holder (6) for holding the sample vessels can be moved by a drive unit (5') in the horizontal direction (arrow d).

Figure 4:
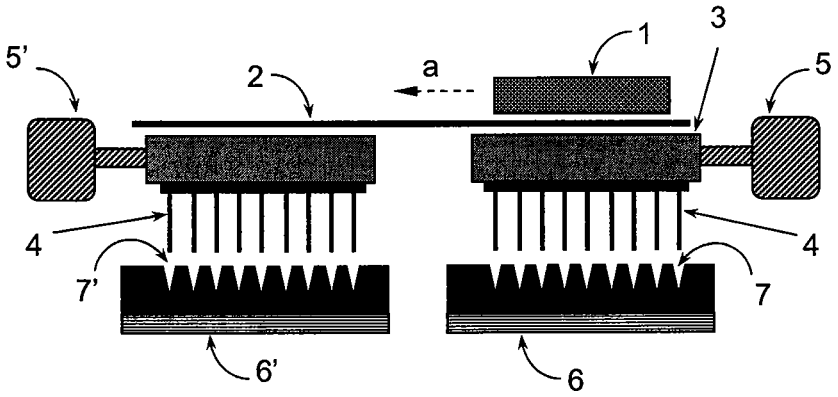
FIG. 4 is a side schematic view of yet another embodiment of a device according to the present invention with two units combined.

FIG. 4 depicts a further embodiment of the invention wherein two units—each having a head piece (3), magnetizable bars (4) and holder (6)—are combined with each other, and the magnet (1) can be positioned alternately above the one head piece or the other (3), via a rail (2).

The above-described devices and methods can be used to advantage in the methods and techniques mentioned at the outset, and they can be adapted in a simple manner to different requirements.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A device for separating magnetic or magnetizable particles from a liquid by using a magnetic field, wherein the device (10) comprises a head piece (3) comprising a plurality of magnetizable bars connected in a fixed or detachable manner to a bottom side of the head piece (3), the magnetizable bars being oriented substantially vertically;

at least one permanent magnet (1) arranged to be movable with respect to the head piece in a horizontal plane, and whose relative position with respect to the head piece can be changed by a predeterminable movement of the magnet or/and by a predeterminable movement of the head piece, such that the permanent magnet alternately assumes a first position substantially vertically above and horizontally aligned with the head piece, or a second position horizontally offset from the head piece, wherein the at least one permanent magnet is supported on rails, rollers, or gear racks or on a rotatable device to effect the predeterminable movement of the at least one magnet in the horizontal plane, and/or the device further comprises a mechanism which causes the head piece to perform a type of motion selected from the group consisting of a translatory movement, a movement along a circular path, a movement along an elliptic path, a movement along an irregular path, and a shaking motion, in each case within the horizontal plane to effect the predeterminable movement of the head piece in the horizontal plane.

2. The device according to claim 1, wherein the magnetizable bars (4) are attached to a base plate (9) and form a unit therewith, the base plate being detachably connected to the head piece (3).

3. The device according to claim 2, wherein the plurality of magnetizable bars are arranged on the base plate (9) in at least one row, each row containing a plurality of the magnetizable bars (4).

4. The device according to claim 2, wherein the base plate (9) is detachably connected to the head piece and/or removable therefrom by at least one actuator selected from the group consisting of electromotive, pneumatic, electromagnetic, and hydraulic drives.

5. The device according to claim 1, wherein the magnetizable bars are provided with strippable, replaceable shells (8).

6. The device according to claim 5, wherein the plurality of the strippable, replaceable shells form a common unit (8').

7. The device according to claim 5, wherein each strippable, replaceable shell (8) is retainable at the respective magnetizable bar (4) or at the head piece (3), or is removable from the respective magnetizable bar (4) or the head piece (3) by at least one actuator selected from the group consisting of electromotive, pneumatic, electromagnetic, and hydraulic drives.

8. The device according to claim 1, wherein the head piece is arranged so as to be moveable and can be set into motion by a drive device, the drive device comprising at least on of electromotive, pneumatic, electromagnetic or hydraulic drives.

9. The device according to claim 8, further comprising a mechanism which causes the head piece to perform movements in a vertical direction, the vertical direction corresponding substantially to the longitudinal direction of the magnetizable bars (4').

10. The device according to claim 1, further comprising a holder (6) for at least one sample vessel (7).

11. The device according to claim 10, wherein the holder (6) is arranged so as to be moveable and the holder (6) can be set in motion by a drive, such that the at least one sample vessel (7) can be positioned within a region lying below the magnetizable bars (4) or outside the region, the drive of the holder (6) comprising at least one of electromotive, pneumatic, electromagnetic, and hydraulic drives.

12. The device according to claim 10, wherein the holder (6) is moveably arranged in such a manner that it is able to perform at least one type of motion set out below:

translatory movements in a horizontal plane;

movements along a circular path, an elliptic path or an irregular closed path, in each case within a horizontal plane; and movements in a vertical direction, the vertical direction corresponding substantially to the longitudinal direction of the magnetizable bars (4).

13. The device according to claim 10, wherein the holder (6) is a component of a program-controlled laboratory robot system and is adapted such that a plurality of individual ones or groups of the at least one sample vessel (7) is alternately moved into a position below the magnetizable bars (4) and subsequently, after a predeterminable time interval, again into a position which is outside the region below the magnetizable bars.

14. The device according to claim 10, wherein vertical movement of the holder (6) can be adjusted or controlled by an open-loop control unit or a closed-loop control unit, such that an upward movement of the holder (6) causes the magnetizable bars (4) to be immersed in the at least one sample vessel (7), which is filled with liquid.

15. The device according to claim 1, wherein at least one of the head piece and the holder is capable of performing shaking or vibrating movements.

16. The device according to claim 1, wherein the head piece is permanently attached to the magnetizable bars.

17. The device according to claim 1, wherein the permanent magnet (1) is displaceably arranged on rails, rollers, or gear racks, such that the magnet can be moved from outside into the first position located substantially vertically above the head piece (3), and then again out of the first position.

18. The device according to claim 1, wherein the permanent magnet (1) is arranged so as to be rotatable or tiltable.

19. The device according to claim 1, wherein the movement of the permanent magnet is accomplished by a drive device comprising at least one of electromotive, pneumatic, electromagnetic, and hydraulic drives.

20. The device according to claim 1, further comprising a program-controlled processor connected thereto, such that at least one of the following functions of the device can be open-loop controlled or closed-loop controlled, or such that at least two of the functions mentioned below can be coordinated with one another:

movement of the permanent magnet (1), particularly the time intervals within which the magnet is positioned above the magnetizable bars (4);

movement of the head piece (3) in at least one of horizontal and vertical directions, particularly duration, frequency and amplitude of a shaking or vibrating motion;

actuating detachable attachment of a base plate (9) to the head piece (3) and removal of the base plate from the head piece;

actuating retaining of strippable, replaceable shells (8) at the magnetizable bars (4) and removing the strippable, replaceable shells (8) from the magnetizable bars (4);

movement of a holder (6) to position at least one sample vessel (7) alternately below the magnetizable bars (4) and subsequently to remove the at least one sample vessel from that position, particularly velocity and frequency of the movements, as well as the dwell time of the holder below the magnetizable bars;

vertical movement of the holder (6) to immerse the magnetizable bars (4) into a liquid of the at least one sample vessel (7) and remove the magnetizable bars therefrom; particularly immersion depth, duration and frequency; and if provided, rotation, shaking or vibrating motion of the holder (6), particularly rotation speed, rotation amplitude and intervals between individual operation phases.

21. The device according to claim 1, further comprising at least one of the below-mentioned means, whose functions are coordinated with functions of the device by a common control:

thermostattable heating or cooling means;

pipetting stations for metered addition of liquids, especially reagents;

suction means for exhausting liquid from a sample vessel by suction;

means for shaking or intermixing a liquid contained in the sample vessel/ and;

analytic apparatuses for photometric measuring or luminescence detection.

22. The device according to claim 1, wherein the magnet (1), when it assumes the first position substantially vertically above the head piece (3), magnetizes the magnetizable bar (4) such that a magnetic field is generated at the tip of the bar (4).

23. The device according to claim 1, wherein the at least one permanent magnet (1) is displaceably arranged on rails, rollers, or gear racks, such that the magnet can be moved from the second position into the first position, and then again out of the first position.

24. The device according to claim 1, wherein the extent of the movement of the permanent magnet is predeterminable and is defined by a rotation angle or a displacement distance.

25. A method for separating magnetic or magnetizable particles from a liquid by using a magnetic field, performed by a device according claim 1, the method comprising the following steps:

a) immersing the plurality of magnetizable bars of the device into the liquid containing the particles;

b) activating a magnetic field by changing a position of the permanent magnet relative to the plurality of magnetizable bars, such that the permanent magnet assumes a position above the head piece, and such that the at least one plurality of magnetizable bars are magnetized and the particles accumulate substantially at lower ends of the plurality of magnetizable bars and adhere thereto; and c) removing the plurality of magnetizable bars, along with the adhering particles, from the liquid.

26. The method according to claim 25, wherein the liquid used in step (a) contains a target substance which is bound specifically, but reversibly, to the particles.

27. The method according to claim 26, further comprising the following additional steps:

d) immersing the plurality of magnetizable bars, along with the particles adhering thereto, in a predetermined volume of a wash liquid;

e) deactivating the magnetic field by an opposite change of the position of the permanent magnet such that the permanent magnet assumes a position which is not above the head piece, whereby the particles are released into the liquid;

f) mixing;

g) magnetizing the plurality of magnetizable bars by changing the position of the permanent magnet, such that the permanent magnet assumes a position above the head piece, and such that the particles accumulate substantially at the lower end of the plurality of magnetizable bars; and h) lifting the plurality of magnetizable bars out of the wash liquid.

28. The method according to claim 26, further comprising the following additional steps:

i) immersing the plurality of magnetizable bars, along with the particles adhering thereto, into a predetermined volume of an elution liquid that causes the elution of a target substance from the particles; and k) lifting the plurality of magnetizable bars of the elution liquid, during which step the particles remain adhering to the plurality of magnetizable bars and are thereby separated from the liquid.

29. A device for separating magnetic or magnetizable particles from a liquid by using a magnetic field, wherein the device (10) comprises:

a head piece (3) comprising a plurality of magnetizable bars connected in a fixed or detachable manner to a bottom side of the head piece (3), the magnetizable bars being oriented substantially vertically;

at least one permanent magnet (1) which is arranged so as to be movable relative to the head piece and in a horizontal plane, and whose relative position with respect to the head piece can be changed by a predeterminable movement of the magnet, such that the permanent magnet alternately assumes a first position substantially vertically above and horizontally aligned with the head piece, or a second position which is horizontally offset from the head piece, wherein the at least one permanent magnet is supported on rails, rollers, or gear racks or on a rotatable device to effect said predeterminable movement of the magnet in the horizontal plane.

* * * * *